US010625291B2

(12) United States Patent
Meier et al.

(10) Patent No.: US 10,625,291 B2
(45) Date of Patent: Apr. 21, 2020

(54) COATING SYSTEM FOR COATING OBJECTS

(71) Applicant: EISENMANN SE, Boeblingen (DE)

(72) Inventors: Ralph Meier, Waldenbuch (DE); Tobias Mozer, Leinfelden-Echterdingen (DE)

(73) Assignee: EISENMANN SE, Böblingen (DE)

( * ) Notice: Subject to any disclaimer, the term of this patent is extended or adjusted under 35 U.S.C. 154(b) by 440 days.

(21) Appl. No.: 15/328,642

(22) PCT Filed: Jul. 24, 2015

(86) PCT No.: PCT/EP2015/001530

§ 371 (c)(1),
(2) Date: Jan. 24, 2017

(87) PCT Pub. No.: WO2016/012100

PCT Pub. Date: Jan. 28, 2016

(65) Prior Publication Data

US 2017/0216870 A1 Aug. 3, 2017

(30) Foreign Application Priority Data

Jul. 24, 2014 (DE) ..... 10 2014 010 864

(51) Int. Cl.
*B05B 15/55* (2018.01)
*B05B 14/00* (2018.01)
(Continued)

(52) U.S. Cl.
CPC ..... *B05B 15/557* (2018.02); *B05B 5/04* (2013.01); *B05B 5/16* (2013.01); *B05B 12/14* (2013.01);
(Continued)

(58) Field of Classification Search
CPC ..... B05B 15/557; B05B 15/55; B05B 15/58; B05B 14/00; B05B 12/14; B05B 12/149; B05B 5/04; B05B 5/16
(Continued)

(56) References Cited

U.S. PATENT DOCUMENTS 4,881,563 A 11/1989 Christian
5,676,756 A * 10/1997 Murate ..... B05B 3/1057 118/302
(Continued)

FOREIGN PATENT DOCUMENTS

CN 101 557 881 10/2009
CN 103 301 969 9/2013
(Continued)

OTHER PUBLICATIONS

Translation of Office Action issued by Chinese Patent Office in related application CN Pat. App. No. 201580040894X, 11 total pages.

*Primary Examiner* — Jason J Boeckmann
(74) *Attorney, Agent, or Firm* — Schroeder Intellectual Property Law Group, LLC

(57) ABSTRACT

A coating system for coating objects, wherein a coating material can be dispensed by an application device with a dispensing arrangement. A supply system having at least first and second feed containers for coating material are connected via first and second supply lines and first and second material valves, respectively, to the dispensing arrangement. Also provided is a cleaning system having at least one first cleaning line and a second cleaning line, to which rinsing agent can be fed via a first rinsing agent feed line and a second rinsing agent feed line, respectively. The first and second cleaning lines are connected via first and second cleaning valves to the first and supply lines, respectively. The first cleaning line and the second cleaning line are
(Continued)

connected via a connection line at connection points disposed in front of each cleaning valve relative to the flow direction towards the dispensing arrangement.

14 Claims, 8 Drawing Sheets

(51) Int. Cl.
*B05B 5/04* (2006.01)
*B05B 5/16* (2006.01)
*B05B 12/14* (2006.01)
*B05B 15/58* (2018.01)

(52) U.S. Cl.
CPC ..... *B05B 12/149* (2013.01); *B05B 14/00* (2018.02); *B05B 15/55* (2018.02); *B05B 15/58* (2018.02)

(58) Field of Classification Search
USPC ..... 239/112, 116, 124
See application file for complete search history.

(56) References Cited

U.S. PATENT DOCUMENTS

| | | | | |
|---|---|---|---|---|
| 5,964,407 | A | 10/1999 | Sandkleiva | |
| 6,193,167 | B1 * | 2/2001 | Sunde | B05B 12/14 239/112 |
| 8,333,164 | B2 | 12/2012 | Herre et al. | |
| 9,089,864 | B2 | 7/2015 | Herre et al. | |
| 2003/0041884 | A1 | 3/2003 | Bahr | |
| 2005/0139237 | A1 | 6/2005 | Bahr | |
| 2008/0023571 | A1 * | 1/2008 | Heldt | B05B 5/1633 239/112 |
| 2010/0012025 | A1 | 1/2010 | Herre et al. | |
| 2010/0133353 | A1 | 6/2010 | Herre | |
| 2011/0014371 | A1 | 1/2011 | Herre et al. | |
| 2011/0076411 | A1 | 3/2011 | Nussbaum | |
| 2012/0037716 | A1 | 2/2012 | Heldt et al. | |
| 2013/0108796 | A1 | 5/2013 | Michelfelder et al. | |
| 2013/0122212 | A1 * | 5/2013 | Marty | B05B 5/1608 427/484 |
| 2013/0230661 | A1 | 9/2013 | Takebe et al. | |
| 2015/0314315 | A1 | 11/2015 | Herre et al. | |

FOREIGN PATENT DOCUMENTS

| | | | |
|---|---|---|---|
| CN | 203 540 814 | | 4/2014 |
| DE | 43 30 602 | A1 | 3/1994 |
| DE | 696 22 407 | T2 | 3/2003 |
| DE | 10 2006 048 037 | A1 | 4/2008 |
| DE | 10 2006 058 562 | A1 | 8/2008 |
| DE | 10 2008 015 494 | A1 | 10/2009 |
| DE | 10 2010 010 053 | A1 | 9/2011 |
| EP | 1 284 162 | A1 | 2/2003 |

* cited by examiner

COATING SYSTEM FOR COATING OBJECTS

RELATED APPLICATIONS

This application is a national phase of International Patent Application No. PCT/EP2015/001530, filed Jul. 24, 2015, which claims the filing benefit of German Patent Application No. 10 2014 010 864.3, filed Jul. 24, 2014, the contents of both of which are incorporated herein by reference.

FIELD OF THE INVENTION

The invention relates to a coating system for coating objects, comprising a) an application device having a dispensing arrangement, by means of which a coating material can be dispensed;

b) a supply system, which comprises at least:

ba) a first feed reservoir for coating material, which is connected via a first supply line and a first material valve to the dispensing arrangement;

bb) a second feed reservoir for coating material, which is connected via a second supply line and a second material valve to the dispensing arrangement;

c) a cleaning system having at least one first cleaning line, to which flushing medium can be fed via a first flushing medium feed line, and a second cleaning line, to which flushing medium can be fed via a second flushing medium feed line;

wherein d) the first cleaning line is connected via a first cleaning valve to the first supply line and the second cleaning line is connected via a second cleaning valve to the second supply line.

BACKGROUND OF THE INVENTION

In the present context, lines should be taken to mean all flow paths for fluid media. Thus, these include not only flexible hoses or rigid lines but also channels, flow chambers or even just through openings machined into bodies. In the case of through openings, the axial extent thereof thus specifies the length of the line thereby formed. In principle, the length of a line can be very short in complex systems and, in the case of through openings, can be just 1 mm, for example, depending on the thickness of the material of the element having the through opening.

Coating systems of this kind are used to coat objects such as vehicle bodies or body components with the aid of electrostatically operating application devices, for example in the automotive industry. In this context, the coating material, e.g. a paint, is dispensed by the dispensing arrangement and subjected to an electric field, in which the coating material dispensed is ionized and transferred by virtue of electrostatic forces to the object, which, for this purpose, is at ground potential, for example. An application device of this kind can, for example, be a high-speed rotary atomizer, in which the dispensing arrangement comprises a rotating bell-shaped plate, from which extremely small paint droplets are thrown, thus forming a paint mist.

If an object is to be painted in a different color than the previously coated object, a color change must be performed. To enable a color change to be carried out as quickly as possible and without loss of time, a coating system of the type stated at the outset comprises at least two feed reservoirs, thus allowing alternate operation. In practice, this means that the application device is fed with one first coating material from one feed reservoir, while the other feed reservoir can be loaded with a different coating material, thus ensuring that the system is ready for a color change.

In electrostatically operating systems, the lines must build up an insulating section in a direction away from the application device during the coating process, and must be clean and dry to achieve this. The lines are accordingly manufactured from an electrically insulating material.

In principle, it is important in coating systems that no air should get into the coating materials since it can happen that the material volumes delivered no longer correspond to the volumes required for a coating process.

Upon conclusion of a painting operation, some coating material that has not been applied to the object always remains in the lines. In respect of environmentally friendly techniques, there has been an increasing demand for as much of this material as possible to be recovered. To push material back out of the lines into the respective source without air coming into contact with the material, one of the techniques which has become established is the "pigging technique", in which material is conveyed through the lines with the aid of a pig, which operates as a sliding body. However, this technique is quite complex, and expensive pig changing devices, pig rinsing stations and the like are required.

SUMMARY OF THE INVENTION

It is therefore an object of the invention to provide a coating system of the type stated at the outset in which coating material can be recovered in an effective manner and which offers an alternative to the pigging technique.

This object may be achieved in the case of a coating system of the type stated at the outset in that e) the first cleaning line and the second cleaning line are connected to one another via a connection line, wherein respective connection points are arranged ahead of each of the cleaning valves, relative to the flow direction toward the dispensing arrangement.

By means of this measure, it is possible to use flushing medium as a pushing medium for coating material present in the lines instead of a pig since air can be removed from a particular cleaning line via the connection line and the other cleaning line connected thereto. In this way, flushing medium can be freed from air and forced without bubbles as far as the associated cleaning valve and the coating material present behind said valve, thus preventing the formation of an air cushion or, more generally, a gas cushion between the coating material and the flushing medium, which would disrupt the process. In many cases, use is also made of some other gas as a pushing medium or for drying the lines instead of air, and this gas can remain in the line system. Carbon dioxide, nitrogen or the like are conceivable for this purpose, for example. The connection line at any rate provides a bypass line past the valves.

It is advantageous if the first cleaning line is connected to a discharge line via a first outlet valve, and the second cleaning line is connected to a discharge line via a second outlet valve. The respective outlet valve can then be opened for the purpose of releasing air from the respective cleaning line which is not supplied with flushing medium.

It is particularly advantageous here if a) the first outlet valve is arranged in a first outlet line, and the second outlet valve is arranged in a second outlet line;

b) the first outlet line is connected to the first cleaning line, and the second outlet line is connected to the second cleaning line;

c) the first and the second outlet line open into a discharge manifold.

Thus, a single common discharge manifold can be used for both cleaning lines.

In terms of flow, it is advantageous if a) the first cleaning line, the first flushing medium feed line and the first outlet line open into one another at a first line intersection;

b) the second flushing line, the second flushing medium feed line and the second outlet line open into one another at a second line intersection.

With regard to the feeding of flushing medium, it is effective if the first flushing medium feed line and the second flushing medium feed line are connected to a common flushing medium source via respective flushing medium valves.

To enable the lines to be dried after flushing medium has flowed through, it is advantageous if the cleaning system comprises at least one compressed air source, and compressed air can be fed to the first cleaning line and to the second cleaning line.

Here, a separate feed system is advantageous, where, in the cleaning system, compressed air can be fed to the first cleaning line via a first compressed air feed line, and compressed air can be fed to the second cleaning line via a second compressed air feed line.

Given the presence of line intersections of the type specified above, effective distribution of the compressed air in the line system is achieved if the first compressed air feed line opens into the first line intersection and the second compressed air feed line opens into the second line intersection.

For a well metered supply of coating material to the application device, it is advantageous if the first feed reservoir and/or the second feed reservoir is a piston-type metering device.

The coating system is particularly effective if the application device operates electrostatically and, in particular, is an electrostatically operating high-speed rotary atomizer.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An illustrative embodiment of the invention is explained below with reference to the drawings, in which FIG. 1 schematically shows a coating system having an application device, a supply device and a flushing device.

DETAILED DESCRIPTION OF THE PRESENT INVENTION

Figure 1:
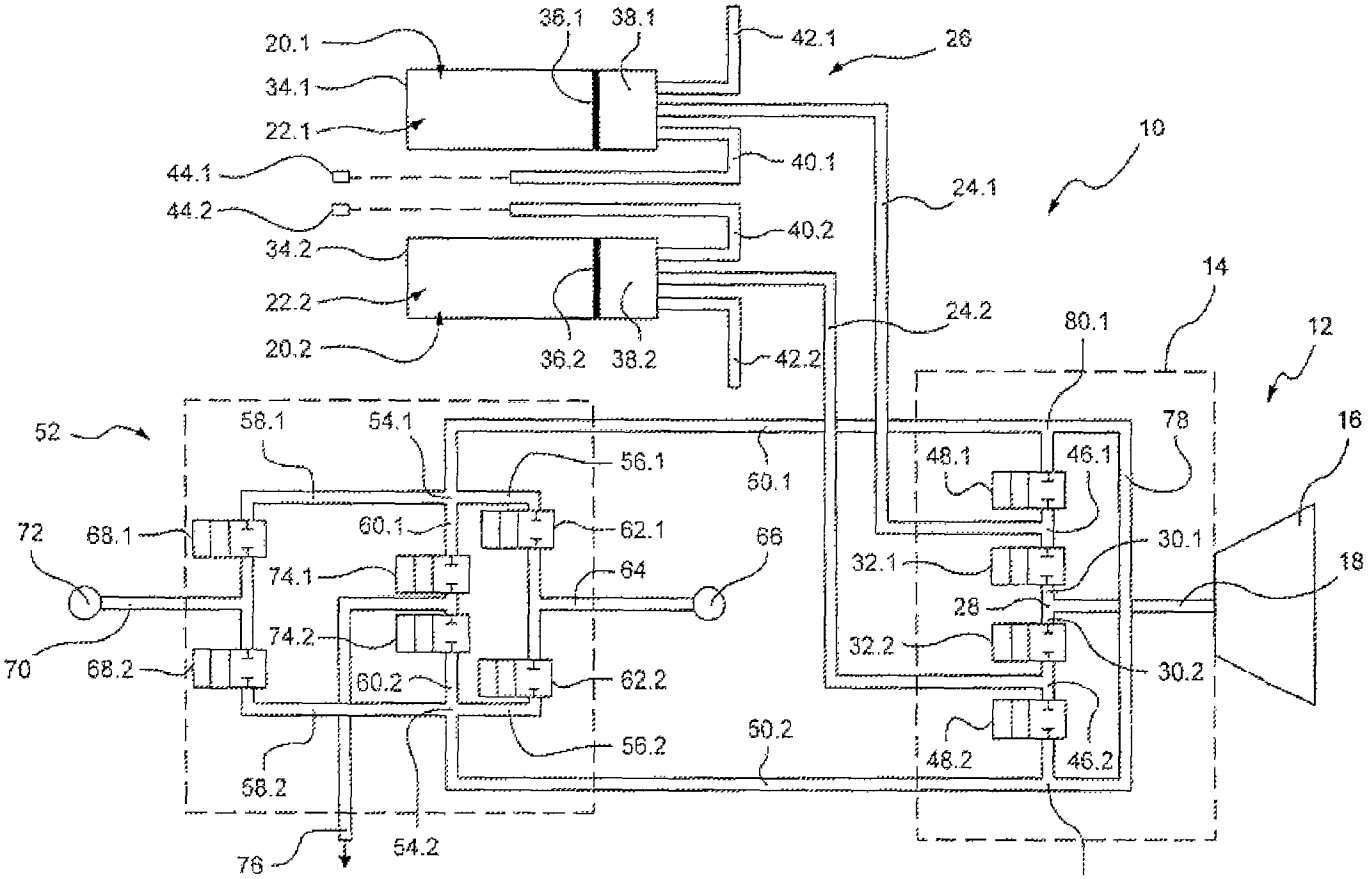

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The figures show schematically a coating system 10 for coating objects, e.g. vehicle bodies or the attached components thereof.

The coating system 10 comprises an application device 12, which is shown only schematically in the illustrative embodiment under consideration. In the illustrative embodiment under consideration, the application device 12 is an electrostatically operating high-speed rotary atomizer 14 having a rotating bell-shaped plate 16.

The application device 12 comprises a dispensing line 18, via which coating material can be dispensed onto an object (not shown per se). In the illustrative embodiment under consideration, the dispensing line 18 leads to the bell-shaped plate 16 of the high-speed rotary atomizer 14. The bell-shaped plate 16 and the dispensing line 18 thus form a dispensing arrangement.

The application device 12 can be fed optionally with material from a first feed reservoir 20.1 in the form of a first piston-type metering device 22.1 via a first supply line 24.1 of a supply system 26 or from a second feed reservoir 20.2 in the form of a piston-type metering device 22.2 via a second supply line 24.2 of the supply system 26. The first piston-type metering device 22.1 and the second piston-type metering device 22.2 each illustrate just one example of a first feed reservoir 20.1 and a second feed reservoir 20.2 for coating material.

To connect the dispensing arrangement 16, 18 to the feed reservoirs 20.1, 20.2, the dispensing line 18 branches at an inlet end 28 into a first inlet arm 30.1 and a second inlet arm 30.2. The first inlet arm 30.1 is connected via a material valve 32.1 to the first supply line 24.1, and the second inlet arm 30.2 is connected via a material valve 32.2 to the second supply line 24.2 of the supply system 26. By way of example, the inlet arms 30.1 and 30.2 can also be formed by through openings in the dispensing line 18, as discussed at the outset.

The piston-type metering device 22.1 comprises a cylinder 34.1, in which a piston 36.1 can be moved with the aid of a piston drive (not shown specifically). With the cylinder 34.1, the piston 36.1 delimits a working chamber 38.1, which is connected to the first supply line 24.1. Moreover, the working chamber 38.1 is connected to an inlet line 40.1 and an outlet line 42.1. The inlet line 40.1 is connected in a manner known per se to a color changing device 44.1, thus allowing the piston-type metering device 22.1 to be filled with different materials.

In a corresponding manner, a cylinder 34.2, a piston 36.2, a working chamber 38.2, an inlet line 40.2, an outlet line 42.2 and a color changing device 44.2 are present in connection with the second piston-type metering device 22.2.

The lines 40.1, 40.2, 42.1 and 42.2 can be closed or opened by valves on the respective piston-type metering device 22.1 and 22.2, which are not shown specifically for the sake of clarity.

At an outlet point 46.1, supply line 24.1 is connected via a cleaning valve 48.1 to a cleaning line 50.1 of a cleaning system 52. The cleaning line 50.1 leads from the cleaning valve 48.1 to a line intersection 54.1, at which the cleaning line 50.1, a flushing medium feed line 56.1, a compressed air feed line 58.1 and an outlet line 60.1 open into one another.

In a corresponding manner, supply line 24.2 is connected at an outlet point 46.2, via a cleaning valve 48.2, to a cleaning line 50.2 of the cleaning system 52, which leads to a line intersection 54.2, into which a flushing medium feed line 56.2, a compressed air feed line 58.2 and an outlet line 60.2 also open.

The cleaning lines 50.1, 50.2 can be supplied with flushing medium. For this purpose, the flushing medium feed lines 56.1, 56.2 can be connected via respective flushing medium valves 62.1 and 62.2 and a Y line 64 to a flushing medium source 66. The compressed air feed lines 58.1 and 58.2 are connected via respective compressed air valves 68.1 and 68.2 and a Y line 70 to a compressed air source 72. The outlet lines 60.1, 60.2 are connected via respective outlet valves 74.1 and 74.2 to a discharge manifold 76.

All the valves 32.1, 32.2, 48.1, 48.2, 62.1, 62.2, 68.1, 68.2 as well as 74.1, 74.2 are shutoff valves, which can selectively close or open the respective line passage.

The cleaning lines 50.1 and 50.2 are connected to one another via a connection line 78. In the illustrative embodiment under consideration, connection points 80.1 and 80.2 for the connection line 78 are in each case arranged ahead of the cleaning valves 48.1 and 48.2 respectively, in each case relative to the flow direction toward the dispensing arrangement 16, 18 with the dispensing line 18 and the bell-shaped plate 16. Consequently, each cleaning line 50.1, 50.2 branches at a connection point 80.1, 80.2 into the connection line 78 and into a respective end segment of the cleaning line 50.1, 50.2, which leads to the respective cleaning valve 48.1 and 48.2.

As explained at the outset, coating material remains in the supply lines 24.1 or 24.2 when an application process involving a coating material is complete.

The fact that the two cleaning lines 50.1 and 50.2 are connected to one another via the connection line 78 makes it possible to convey this coating material back into the associated feed reservoir 20.1 or 20.2, wherein flushing medium can be used as a delivery medium without the need to use a pig.

Figure 2:
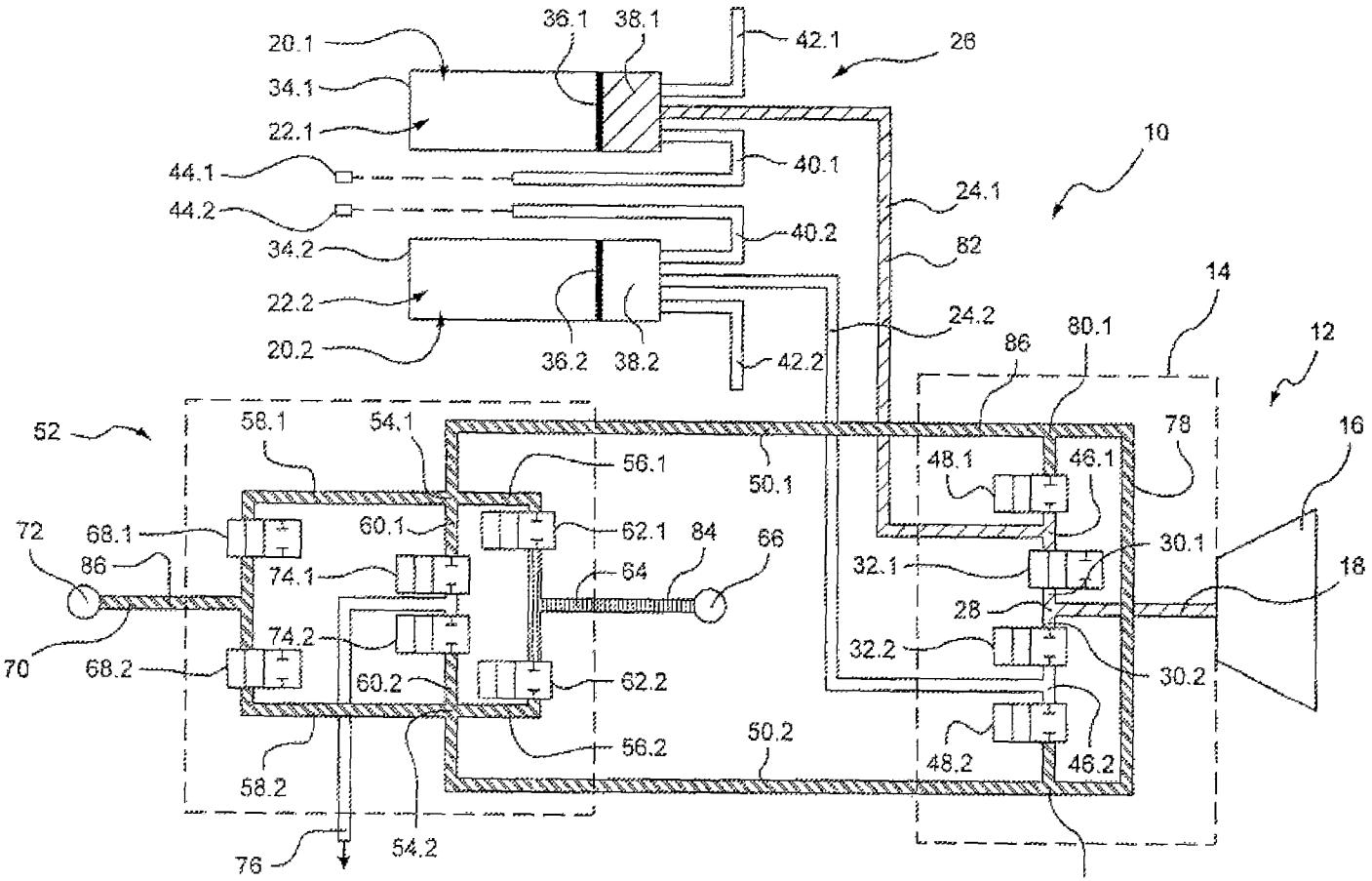
FIGS. 2 to 8 show the coating system of FIG. 1 in various phases of a cleaning process.

This works as follows:

As the starting situation, the application configuration shown in FIG. 2 may be assumed, in which a coating material 82 is applied from the first piston-type metering device 22.1. For this purpose, piston-type metering device 22.1 has previously been filled with the coating material 82 from the associated color changer 44.1. In the figures, the coating material 82 is illustrated with oblique single-line hatching. At the first piston-type metering device 22.1, the access to the first supply line 24.1 is open, and the accesses to inlet line 40.1 and to outlet line 42.1 are closed.

The first material valve 32.1 leading to the dispensing line 18 is open, while the second material valve 32.2 and the first and second cleaning valves 48.1, 48.2 are closed. Piston 36.1 forces the coating material 82 in the direction of the application device 12, by which it is applied to an object.

In the cleaning system 52, the compressed air valves 68.1, 68.2 are open. The flushing medium valves 62.1, 62.2 and the outlet valves 74.1, 74.2 are closed.

In this configuration, the Y line 64 is filled with flushing medium 84 from the flushing medium source 66 as far as the closed flushing medium valves 62.1, 62.2. In the figures, the flushing medium 84 is illustrated by vertical single-line hatching. The lines 70, 58.1, 58.2, 56.1, 56.2, 50.1, 50.2, 60.1, 60.2 and 78 are supplied with compressed air 86 from the compressed air source 72. In the figures, compressed air 86 is illustrated by oblique double-line hatching.

Figure 3:
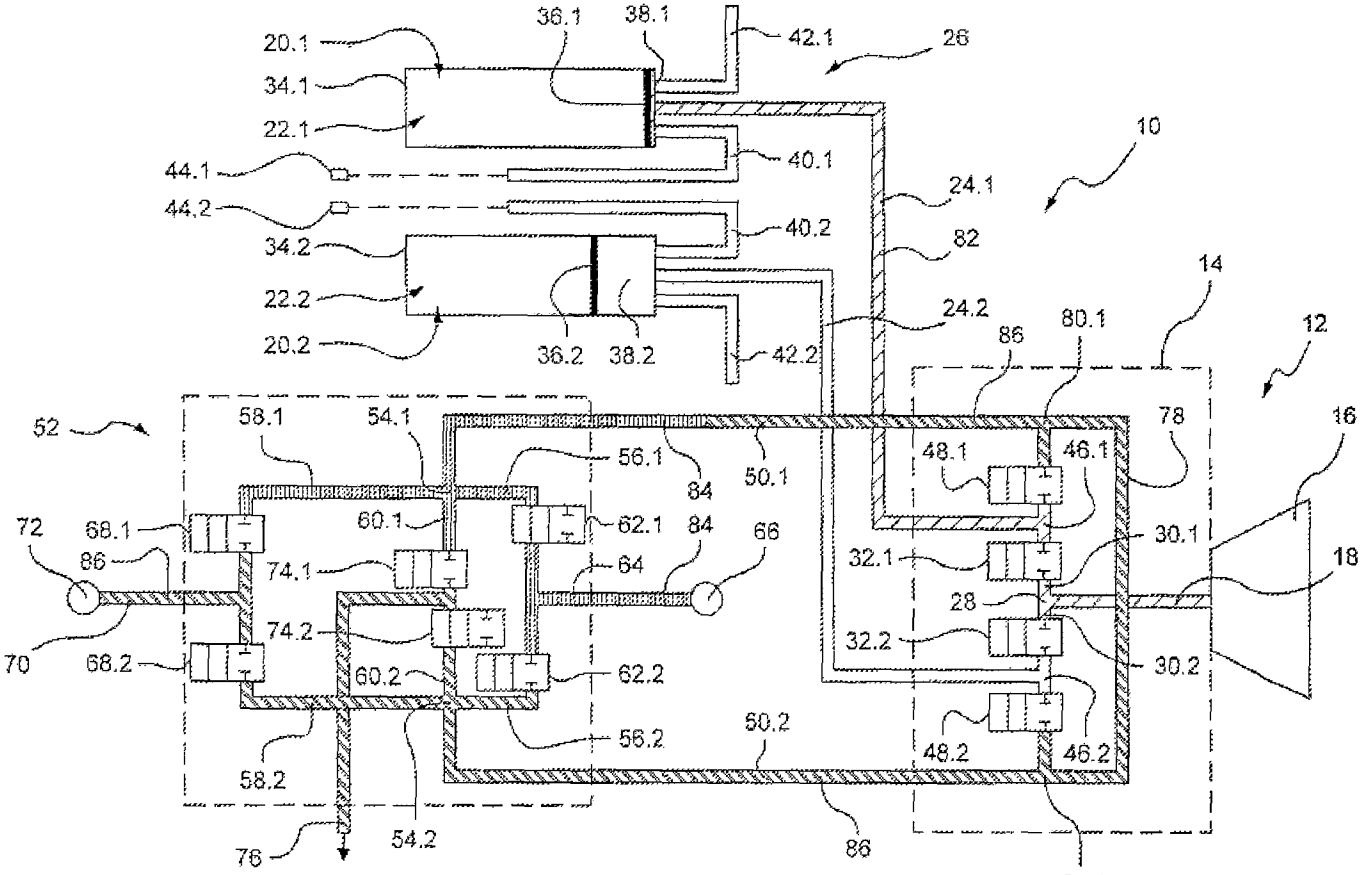

FIG. 3 shows a configuration after the completion of the coating process with the coating material 82. The material valve 32.1 is closed and there is still coating material 82 in the first supply line 24.1.

To clean supply line 24.1 and to recover the coating material 82 there, a cleaning process is then carried out. In this process, the compressed air valves 68.1 and 68.2 are first of all also closed, whereas the first flushing medium valve 62.1 and the second outlet valve 74.2 are opened. As a result, flushing medium 84 flows into the line system and, via cleaning line 50.1, in the direction of the first cleaning valve 48.1. During this process, the flushing medium 84 pushes the compressed air 86 out of the first cleaning line 50.1, via the connection line 78, into the second cleaning line 50.2 and, from there, out of the line system via the now accessible discharge manifold 76.

Figure 4:
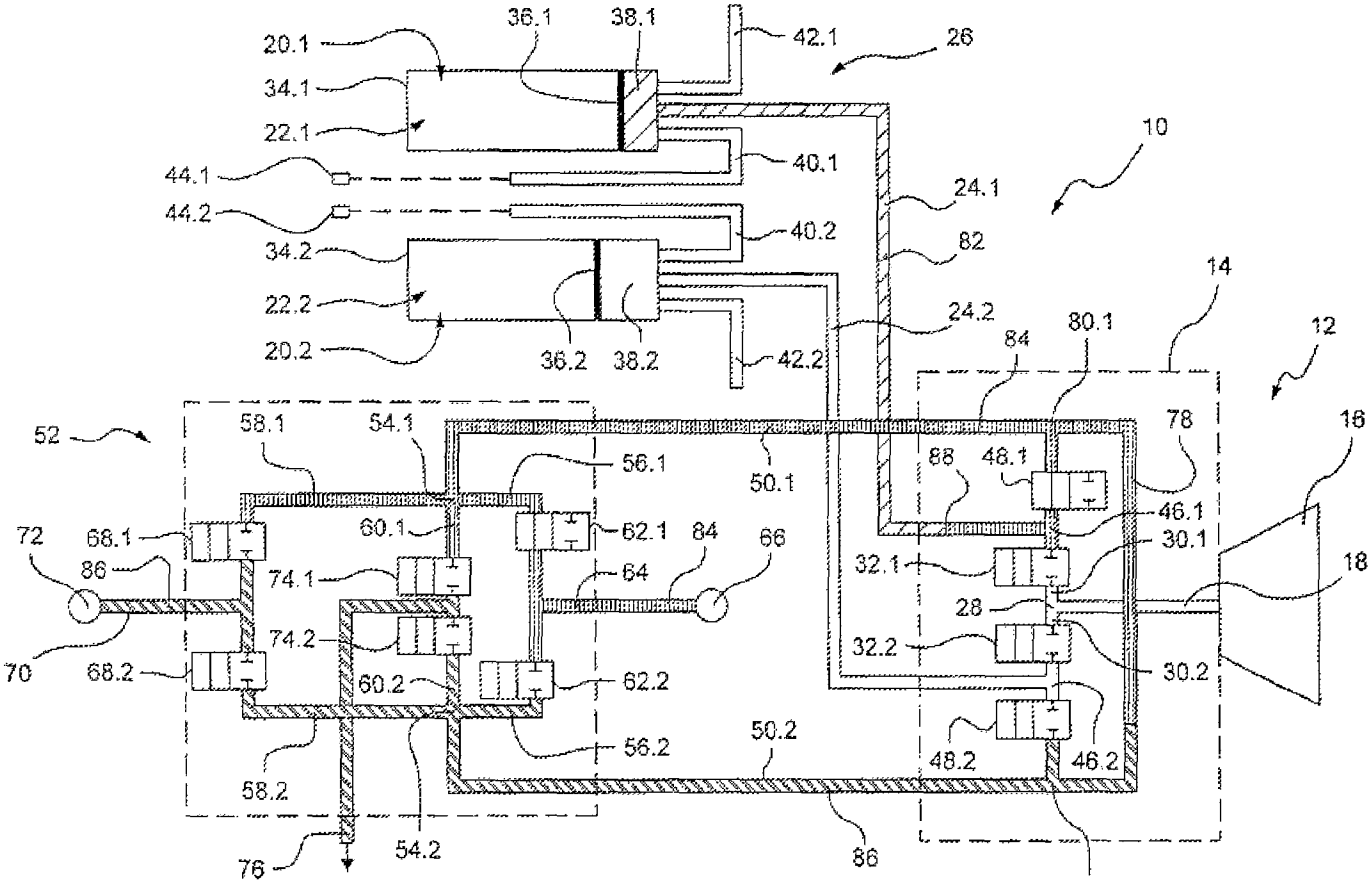

When the flushing medium 84 reaches the first cleaning valve 48.1 and has displaced all the air there, the first cleaning valve 48.1 is opened and outlet valve 74.2 is closed; this situation is shown by FIG. 4. Thus, flushing medium 84 can flow into the first supply line 24.1, wherein it presses against the coating material 82 in the first supply line 24.1 without bubbles, without air in between. During this process, some of the flushing medium 84 continues to flow initially into the line against the pressure of the air situated there until the backpressure which builds up there prevents further inflow of flushing medium 84 into the connection line 78.

The connection line 78 makes it possible to carry the flushing medium 84 to the application device 12 and to supply line 24.1 without air reaching that point. Air or, as discussed at the outset, more generally a gas in or ahead of the flushing medium 84, which would otherwise greatly disrupt the process, can in this way be flushed out of the system.

The flushing medium 84 then pushes the coating material 82 out of the first supply line 24.1 back into the first piston-type metering device 22.1, wherein the phase boundary between the flushing medium 84 and the coating material 82 is denoted by 88.

As can be seen in FIG. 4, the piston 36.1 of the first piston-type metering device 22.1 moves back in corresponding fashion during this process, with the result that working chamber 38.1 increases in size.

Figure 5:
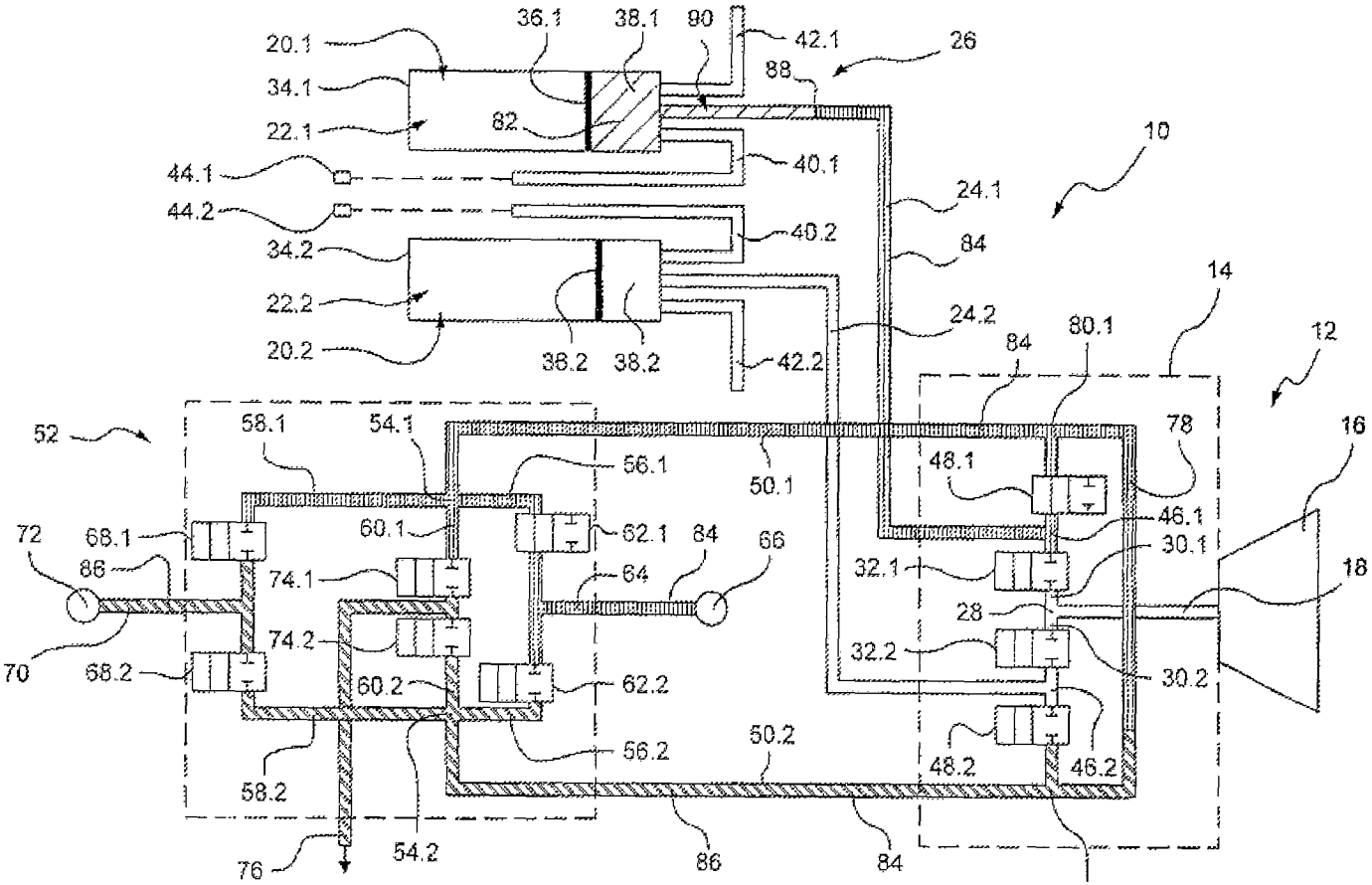

FIG. 5 shows that the coating material 82 is then subsequently pushed back out of the first supply line 24.1 and largely into the first piston-type metering device 22.1. Since a mixed volume of flushing medium 84 and coating material 82 is formed at the phase boundary 88 between the flushing medium 84 and the coating material 82, the process is ended while maintaining a buffer volume 90 ahead of the piston-type metering device 22.1, thus ensuring that none of this mixed volume can enter piston-type metering device 22.1. For example, only 70% of the known volume of the first supply line 24.1 is carried back into piston-type metering device 22.1.

Figure 6:
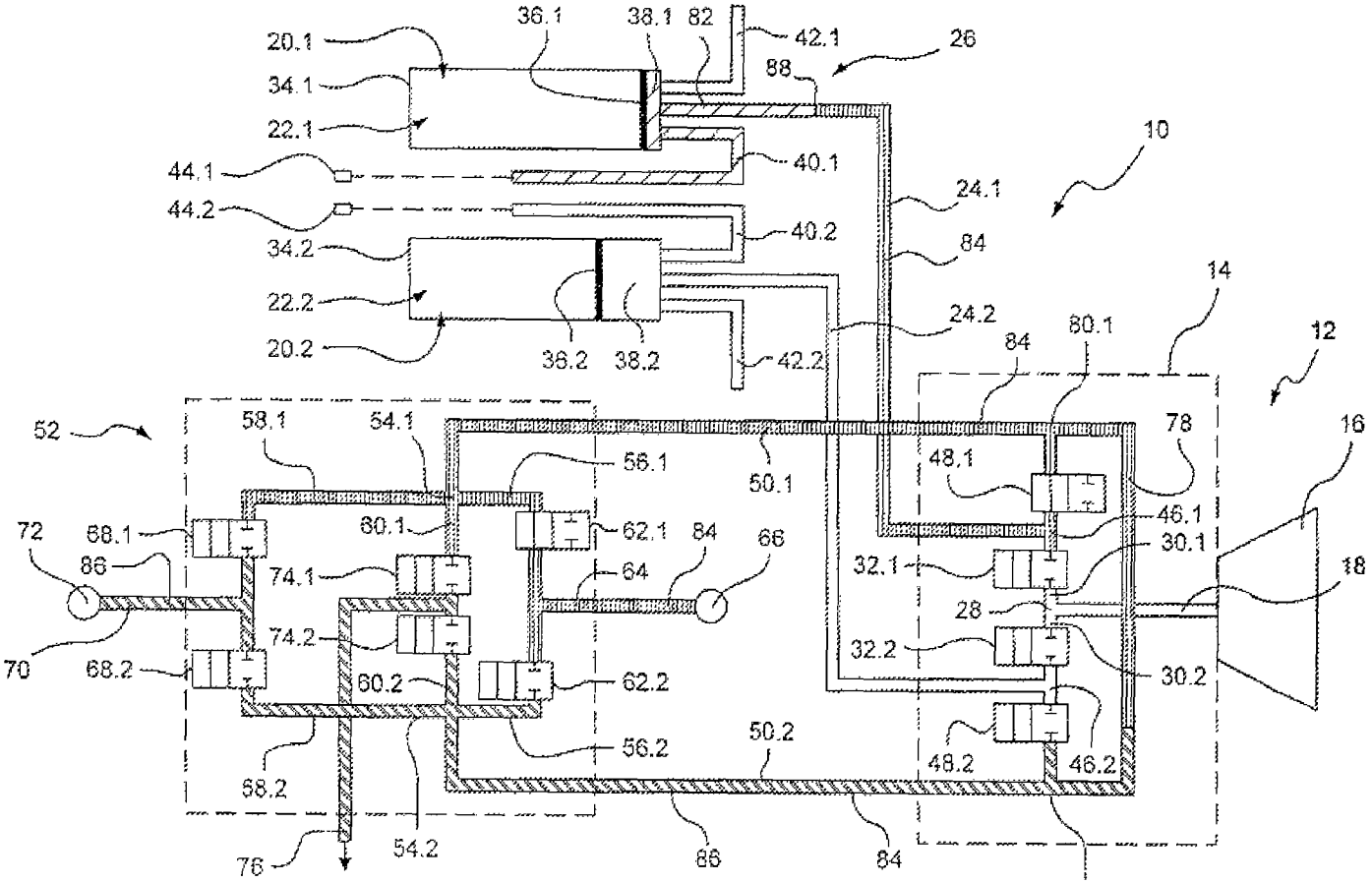

At piston-type metering device 22.1, access to supply line 24.1 is closed, and access to outlet line 42.1 remains closed, whereas access to inlet line 40.1, which leads to color changer 44.1, is opened. As illustrated in FIG. 6, the coating material 82 is then forced by piston 36.1 back to color changer 44.1 via inlet line 40.1 and is there forced into the associated material source.

Figure 7:
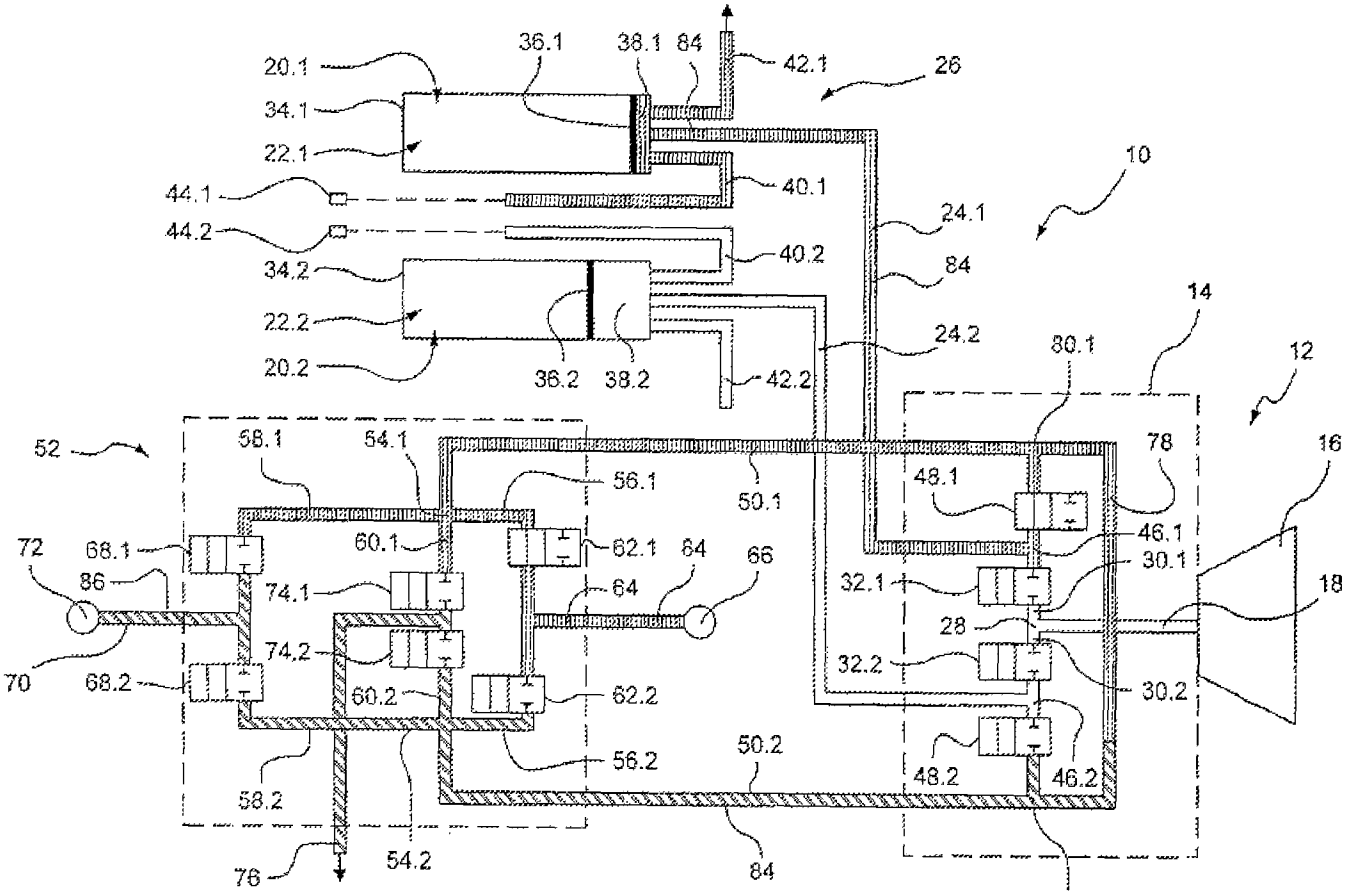

The movement of piston 36.1 is then stopped. At the first piston-type metering device 22.1, access to inlet line 40.1 is closed again, whereas the accesses to the first supply line 24.1 and to outlet line 42.1 are opened. The remainder of the coating material 82 in the first supply line 24.1 is forced through working chamber 38.1 and into outlet line 42.1 by the flushing medium 84. After the reopening of inlet line 40.1, flushing medium 84 is passed via this line as well in order to clean it as far as color changer 44.1. During this process, flushing medium 84 coming from the flushing medium source 66 also continues to flow via the connection line 78, through the second connection line 50.2, in the direction of the discharge manifold 76. This is shown by FIG. 7.

Figure 8:
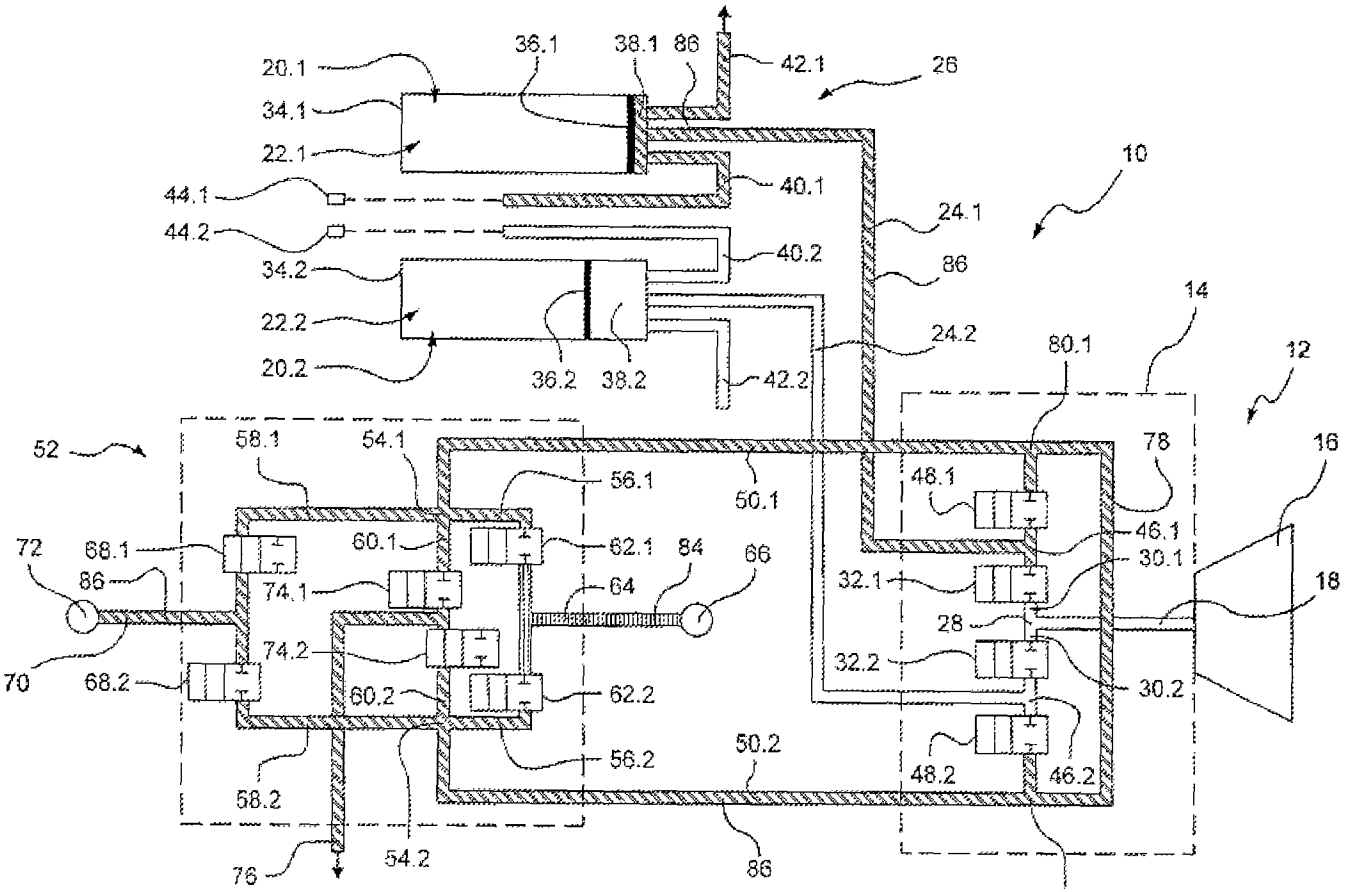

After this, flushing medium valve 62.1 is closed and both compressed air valves 68.1, 68.2 are opened, as a result of which compressed air 86 is forced into the line system. Initially, the compressed air 86 forces all the media present in the lines out of the line system via supply lines 24.1 and piston-type metering device 22.1 and blows them dry. Cleaning valve 48.1 is then closed, outlet valve 74.2 is opened and compressed air valve 68.2 is closed, with the result that compressed air 86 flows via compressed air valve 68.1 through cleaning line 50.1, the connection line 78 and cleaning line 50.2 to outlet valve 74.2 and, from there, through the discharge manifold 76 until all the lines have been blown dry and can be used for the next application process; this last cleaning configuration is illustrated in FIG. 8.

In a sequence which is not shown specifically, the dispensing line 18 is also cleaned by passing flushing medium 84 into the dispensing line 18 via material valve 32.1. With material valve 32.1 open, this line is also blown dry by means of compressed air 86.

The application and cleaning process have been explained only by means of the first piston-type metering device 22.1. During the cleaning process or, if appropriate, also even before, the second piston-type metering device 22.1 has already been filled with a coating material, which is to be applied to an object at a later point in time after coating material 82. For this purpose, the coating system 10 is then switched to a configuration corresponding to that shown in FIG. 2, although, in contrast thereto, the first material valve 32.1 is closed but the second material valve 32.2 is open. After the completion of the coating process, the cleaning process is then carried out mutatis mutandis in a corresponding manner.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

What is claimed is:

1. A coating system for coating objects, comprising:

a) an application device having a dispensing arrangement, by means of which a coating material can be dispensed;

b) a supply system, which comprises at least ba) a first feed reservoir for coating material, which is connected via a first supply line and a first material valve to the dispensing arrangement;

bb) a second feed reservoir for coating material, which is connected via a second supply line and a second material valve to the dispensing arrangement;

c) a cleaning system having at least one first cleaning line which is connected to a flushing medium source via a first flushing medium feed line, and a second cleaning line which is connected to the flushing medium source via a second flushing medium feed line;

wherein d) the at least one first cleaning line is connected via a first cleaning valve to the first supply line and the second cleaning line is connected via a second cleaning valve to the second supply line, and further wherein e) the at least one first cleaning line and the second cleaning line are connected to one another via a connection line, wherein respective first and second connection points are arranged ahead of each of the cleaning valves, relative to the flow direction toward the dispensing arrangement, so that the at least one first cleaning line extends between the first flushing medium feed line and the first connection point, and the second cleaning line extend between the second flushing medium feed line and the second connection point.

2. The coating system as claimed in claim 1, wherein the at least one first cleaning line is connected to a discharge line via a first outlet valve, and the second cleaning line is connected to a discharge line via a second outlet valve.

3. The coating system as claimed in claim 2, wherein a) the first outlet valve is arranged in a first outlet line, and the second outlet valve is arranged in a second outlet line;

b) the first outlet line is connected to the at least one first cleaning line, and the second outlet line is connected to the second cleaning line;

c) the first and the second outlet lines open into a discharge manifold.

4. The coating system as claimed in claim 3, wherein a) the at least one first cleaning line, the first flushing medium feed line and the first outlet line open into one another at a first line intersection;

b) the second flushing line, the second flushing medium feed line and the second outlet line open into one another at a second line intersection.

5. The coating system as claimed in claim 1, wherein the first flushing medium feed line and the second flushing medium feed line are connected to a common flushing medium source via respective flushing medium valves.

6. The coating system as claimed in claim 4, wherein the cleaning system comprises at least one compressed air source, and compressed air can be fed to the at least one first cleaning line and to the second cleaning line.

7. The coating system as claimed in claim 6, wherein in the cleaning system, compressed air can be fed to the at least one first cleaning line via a first compressed air feed line, and compressed air can be fed to the second cleaning line via a second compressed air feed line.

8. The coating system as claimed in claim 7, wherein the first compressed air feed line opens into the first line intersection and the second compressed air feed line opens into the second line intersection.

9. The coating system as claimed in claim 1, wherein the first feed reservoir and/or the second feed reservoir is a piston-type metering device.

10. The coating system as claimed claim 1, wherein the application device operates electrostatically.

11. The coating system as claimed in claim 1, wherein the cleaning system comprises at least one compressed air source, and compressed air can be fed to the at least one first cleaning line and to the second cleaning line.

12. The coating system as claimed claim 10, wherein the application device is an electrostatically operating high-speed rotary atomizer.

13. The coating system as claimed in claim 1, wherein the first flushing medium feed line is connected to a first end of the at least one first cleaning line and the connection line is connected to a second end of the at least one first cleaning line.

14. The coating system as claimed in claim 13, wherein the second flushing medium feed line is connected to a first end of the second cleaning line and the connection line is connected to a second end of the second cleaning line.

* * * * *